US010480358B2

(12) United States Patent
Son et al.

(10) Patent No.: US 10,480,358 B2
(45) **Date of Patent: *Nov. 19, 2019**

(54) CONTINUOUSLY VARIABLE VALVE TIMING APPARATUS AND ENGINE PROVIDED WITH THE SAME

(71) Applicant: HYUNDAI MOTOR COMPANY, Seoul (KR)

(72) Inventors: You Sang Son, Suwon-si (KR); Kyoung Pyo Ha, Seongnam-si (KR); Back Sik Kim, Osan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 1026 days.

This patent is subject to a terminal disclaimer.

(21) Appl. No.: 14/941,193

(22) Filed: Nov. 13, 2015

(65) Prior Publication Data

US 2016/0369664 A1 Dec. 22, 2016

(30) Foreign Application Priority Data

Jun. 22, 2015 (KR) ..... 10-2015-0088631

(51) Int. Cl.
*F01L 1/344* (2006.01)
*F01L 13/00* (2006.01)

(52) U.S. Cl.
CPC ..... *F01L 1/34403* (2013.01); *F01L 13/00* (2013.01); *F01L 2013/11* (2013.01)

(58) Field of Classification Search
CPC ..... F01L 13/00; F01L 13/0015; F01L 1/047; F01L 1/26; F01L 1/267; F01L 1/34403; F01L 2013/0052; F01L 2013/11; F01L 2820/032
USPC ..... 123/90.15–90.18, 90.48
See application file for complete search history.

(56) References Cited

U.S. PATENT DOCUMENTS 5,924,334 A 7/1999 Hara et al.

FOREIGN PATENT DOCUMENTS

| | | | |
|---|---|---|---|
| CN | 102235200 | A | 11/2011 |
| CN | 102477879 | A | 5/2012 |
| CN | 104131854 | A | 11/2014 |
| CN | 204082245 | U | 1/2015 |
| CN | 104727875 | A | 6/2015 |
| JP | 06-185321 | | 7/1994 |

(Continued)

*Primary Examiner* — Mark A Laurenzi
*Assistant Examiner* — Paul W Thiede
(74) *Attorney, Agent, or Firm* — Brinks Gilson & Lione

(57) ABSTRACT

A continuously variable valve timing apparatus may include a camshaft, a first and a second cam portions having two cams formed thereto, of which the camshaft is inserted thereinto, and of which relative phase angles with respect to the camshaft are variable. First and second inner brackets transmit rotation of the camshaft to the first and second cam portions respectively. First and second slider housings having first and second inner brackets are rotatably inserted thereinto, respectively, and have relative positions with respect to the camshaft that are variable. A cam cap rotatably supports the first and second cam portions together with a cylinder head, and the slider housings are slidably mounted thereto. A control shaft is disposed parallel with the camshaft and selectively moves the first and the second slider housings, and a control portion selectively rotates the control shaft so as to change positions of the inner brackets.

18 Claims, 10 Drawing Sheets

(56) References Cited

FOREIGN PATENT DOCUMENTS

| | | |
|---|---|---|
| JP | 09-041924 | 2/1997 |
| JP | 558219562 | 9/2014 |

CONTINUOUSLY VARIABLE VALVE TIMING APPARATUS AND ENGINE PROVIDED WITH THE SAME

CROSS-REFERENCE TO RELATED APPLICATION

This application claims priority to and the benefit of Korean Patent Application No. 10-2015-0088631 filed on Jun. 22, 2015, the entire contents of which are incorporated herein by reference.

FIELD

The present disclosure relates to a continuously variable valve timing apparatus and an engine provided with the same.

BACKGROUND

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various research, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The above information disclosed in this Background section is only for enhancement of understanding of the present disclosure and may contain information that is not already known in this country to a person of ordinary skill in the art.

SUMMARY

Various aspects of the present disclosure include directly providing a continuous variable valve timing apparatus and an engine provided with the same which may vary valve timing according to operation conditions of an engine, with a simple construction.

A continuously variable valve timing apparatus according to an exemplary embodiment of the present disclosure may include a camshaft, a first and a second cam portions of which two cams are formed thereto, of which the camshaft is inserted thereinto and of which relative phase angles with respect to the camshaft are variable, a first and a second inner brackets transmitting rotation of the camshaft to the first and second cam portions respectively, a first and a second slider housings of which the first and second inner brackets are rotatably inserted thereinto respectively and of which relative positions with respect to the camshaft are variable, a cam cap rotatably supporting the first and second cam portions together with a cylinder head and of which the slider housings are slidably mounted thereto, a control shaft disposed parallel with the camshaft and selectively moving the first and the second slider housings and a control portion selectively rotating the control shaft so as to change positions of the inner brackets.

The continuously variable valve timing apparatus may further include a rotation ring mounted to the camshaft and of which a ring key transmitting the rotation to the first cam portion and the second cam portion is formed respectively, and wherein a cam key may be formed to the first and second cam portions respectively, and the rotation of the rotation ring may be transmitted to the first and second cam portions through the first and second inner brackets respectively.

The continuously variable valve timing apparatus may further include first pins of which a ring key slot, the each ring key is slidably inserted thereto, is formed thereto respectively and second pins of which a cam key slot, the each cam key is slidably inserted thereto, is formed thereto respectively, and wherein a first sliding pin hole and a second sliding pin hole, of which the first pin and the second pin are inserted thereto respectively, may be formed to the inner brackets.

The first pin and the second pin may be formed as a circular cylinder shape and the first sliding pin hole and the second sliding pin hole may be formed for the first pin and the second pin to be rotated within thereto.

Parts of the first sliding pin hole and the second sliding pin hole may be opened for movements of the ring key and the cam key not to be interrupted.

The continuously variable valve timing apparatus may further include a bearing inserted between the slider housing and the first and the second inner brackets.

A cam cap connecting portion may be formed between the two cams of the cam portions, and the cam cap connecting portion may be rotatably disposed between the cam cap and the cylinder head.

A guide hole may be formed to the each slider housing, and wherein a guide rod inserted into the guide hole may be connected with the cam cap in order to guide movements of the slider housings.

The control portion may include a worm wheel connected to the control shaft, a worm gear engaged with the worm wheel and a control motor selectively rotating the worm gear, and wherein an eccentric protrusion may be formed to an end of the control shaft, and a control hole where the eccentric protrusion is inserted therein may be formed to the slider housing, and wherein the slider housing may move according to operation of the control motor.

The continuously variable valve timing apparatus may further include a sensor unit detecting movements of the slider housings.

The sensor unit may include a sensor plate mounted to the control shaft and a sensor detecting rotations of the sensor plate.

An engine according to an exemplary embodiment of the present disclosure may include a camshaft, a first and a second cam portions of which two cams are formed thereto, of which the camshaft is inserted thereinto, of which relative phase angles with respect to the camshaft are variable, and of which a cam key is formed thereto respectively, a rotation ring mounted to the camshaft and of which two ring keys are formed thereto, a first and a second inner brackets transmitting rotation of the rotation ring to the first and second cam portions respectively, a first and a second slider housings of which the first and second inner brackets are rotatably inserted thereinto respectively and of which relative positions with respect to the camshaft are variable, a cam cap rotatably supporting the first and second cam portions together with a cylinder head and of which the slider housings are slidably mounted thereto, a control shaft disposed parallel with the camshaft and selectively moving the first and the second slider housings and a control portion selectively rotating the control shaft so as to change positions of the inner brackets.

The control portion may include a worm wheel connected to the control shaft, a worm gear engaged with the worm wheel and a control motor selectively rotating the worm gear, and wherein an eccentric protrusion may be formed to an end of the control shaft, and a control hole where the eccentric protrusion is inserted therein may be formed to the slider housing, and wherein the slider housing may move according to operation of the control motor.

The engine may further include first pins of which a ring key slot, the each ring key is slidably inserted thereto, is formed thereto respectively and second pins of which a cam key slot, the each cam key is slidably inserted thereto, is formed thereto respectively, and wherein a first sliding pin hole and a second sliding pin hole, of which the first pin and the second pin are inserted thereto respectively, may be formed to the inner brackets.

The engine may further include a bearing inserted between the slider housing and the first and the second inner brackets.

A cam cap connecting portion may be formed between the two cams of the cam portions, and the cam cap connecting portion may be rotatably disposed between the cam cap and the cylinder head.

A guide hole may be formed to the each slider housing, and wherein a guide rod inserted into the guide hole may be connected with the cam cap in order to guide movements of the slider housings.

The engine may further include a sensor plate mounted to the control shaft and a sensor detecting rotations of the sensor plate.

As described above, a continuous variable valve timing apparatus according to an embodiment of the present disclosure may vary valve timing according to operation conditions of an engine, with a simple construction.

The continuous variable valve timing apparatus according to an embodiment of the present disclosure may be reduced in size and thus the entire height of a valve train may be reduced.

Since the continuous variable valve timing apparatus may be applied to an existing engine without excessive modification, thus productivity may be enhance and production cost may be reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
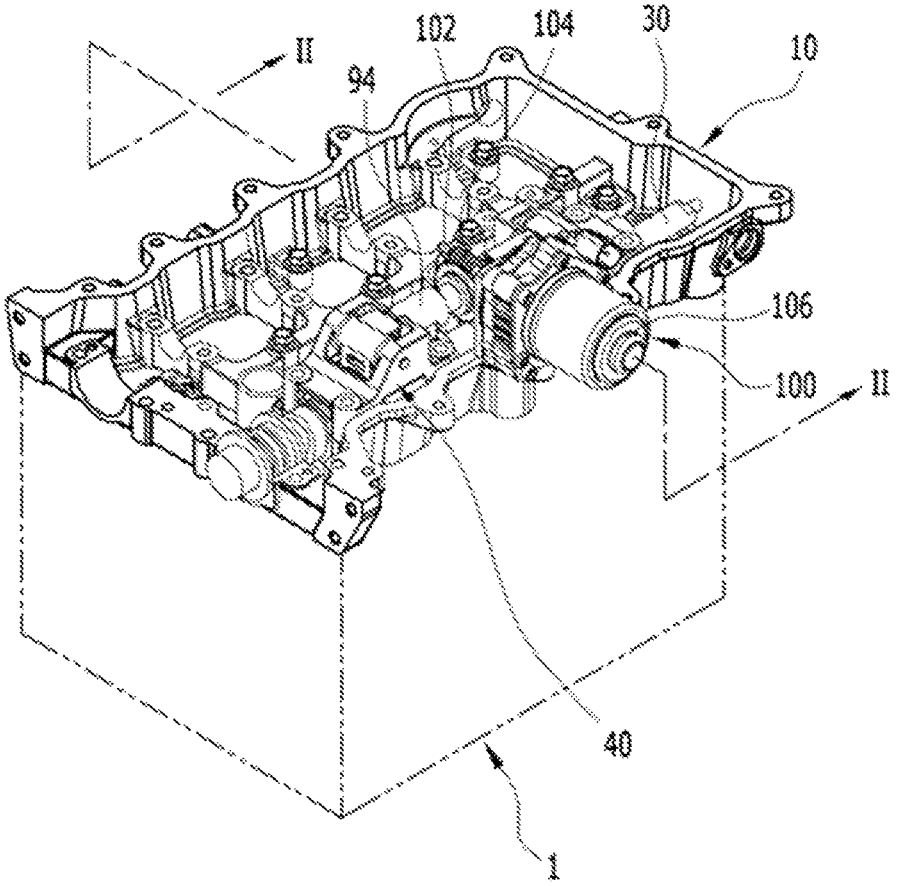
FIG. 1 is a perspective view of an engine provided with a continuous variable valve timing apparatus according to an exemplary embodiment of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following detailed description, only certain exemplary embodiments of the present disclosure have been shown and described, simply by way of illustration.

As those skilled in the art would realize, the described embodiments may be modified in various different ways, all without departing from the spirit or scope of the present disclosure The same or similar elements will be designated by the same reference numerals throughout the specification.

In the drawings, the thickness of layers, films, panels, regions, etc., are exaggerated for clarity.

An embodiment of the present disclosure will hereinafter be described in detail with reference to the accompanying drawings.

Figure 2:
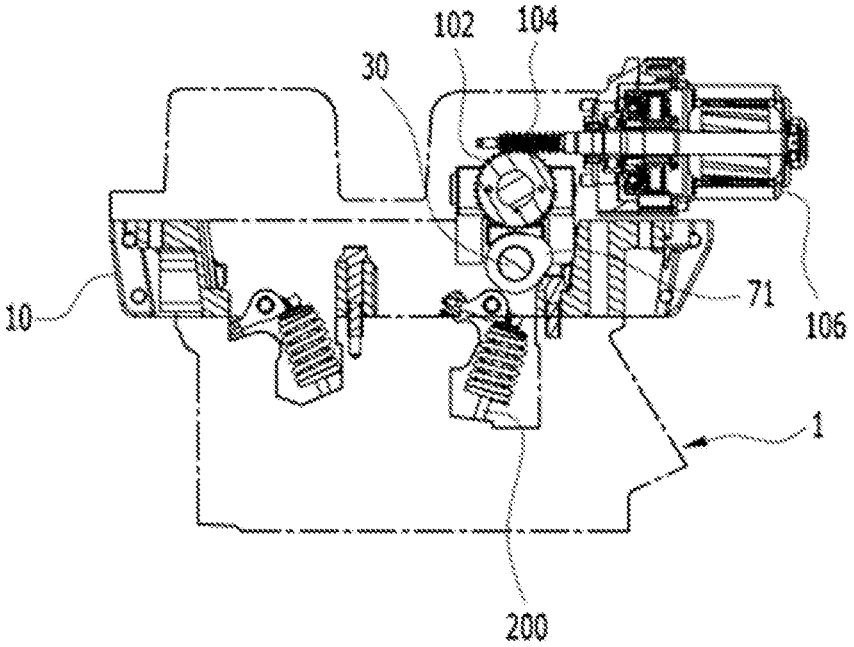
FIG. 2 is a cross-sectional view along a line II-II of FIG. 1.
Figure 3:
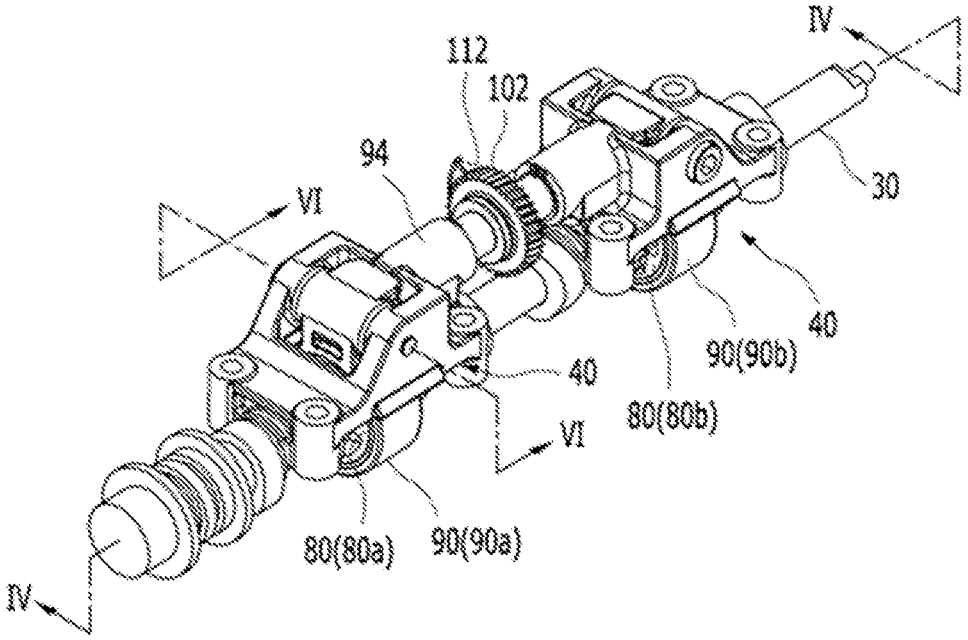
FIG. 3 is a perspective view of a continuous variable valve timing apparatus according to an exemplary embodiment of the present disclosure.

FIG. 1 is a perspective view of an engine provided with a continuous variable valve timing apparatus according to an embodiment of the present disclosure, FIG. 2 is a cross-sectional view along a line II-II of FIG. 1 and FIG. 3 is a perspective view of a continuous variable valve timing apparatus according to an embodiment of the present disclosure.

Figure 4:
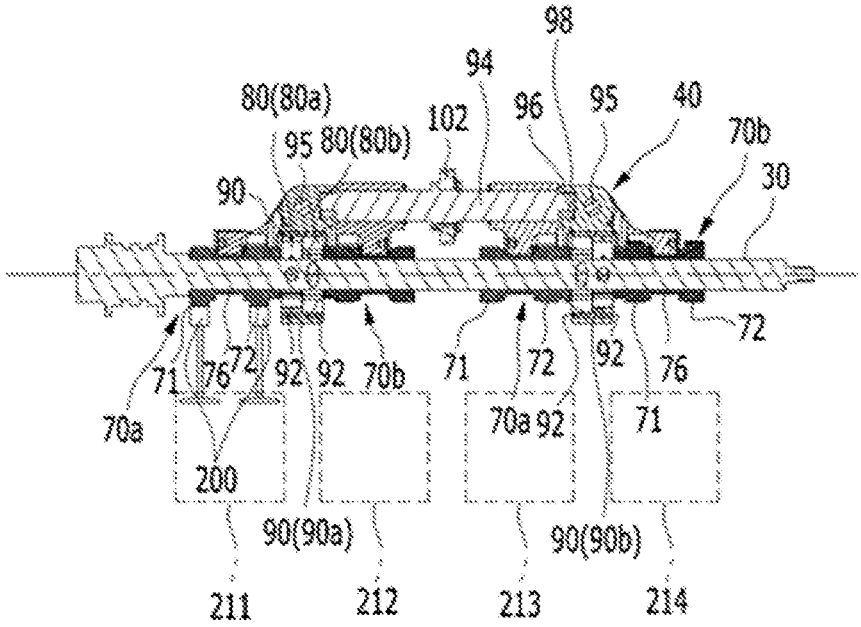
FIG. 4 is a cross-sectional view along a line IV-IV of FIG. 3.
Figure 5:
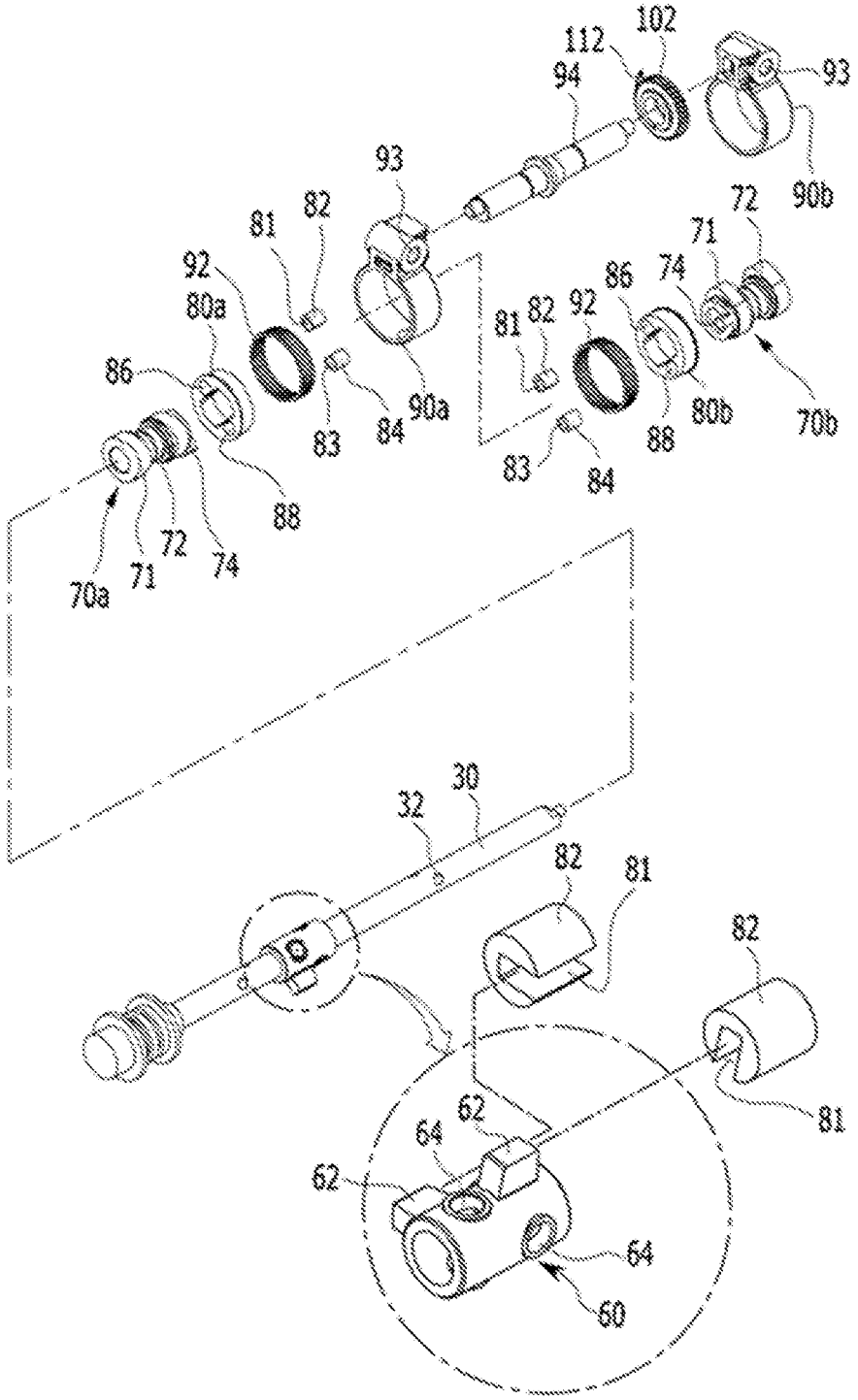
FIG. 5 is a partial exploded perspective view of a continuous variable valve timing apparatus according to an exemplary embodiment of the present disclosure.

FIG. 4 is a cross-sectional view along a line IV-IV of FIG. 3 and FIG. 5 is a partial exploded perspective view of a continuous variable valve timing apparatus according to an embodiment of the present disclosure.

Figure 6:
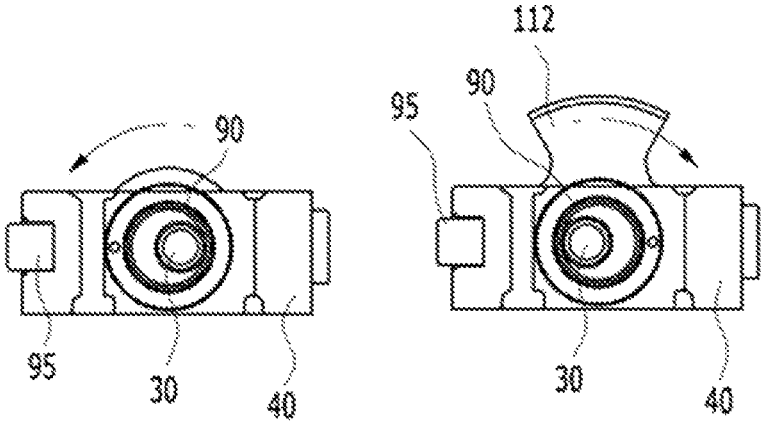
FIG. 6 is a cross-sectional view along a line VI-VI of FIG. 4.
Figure 7:
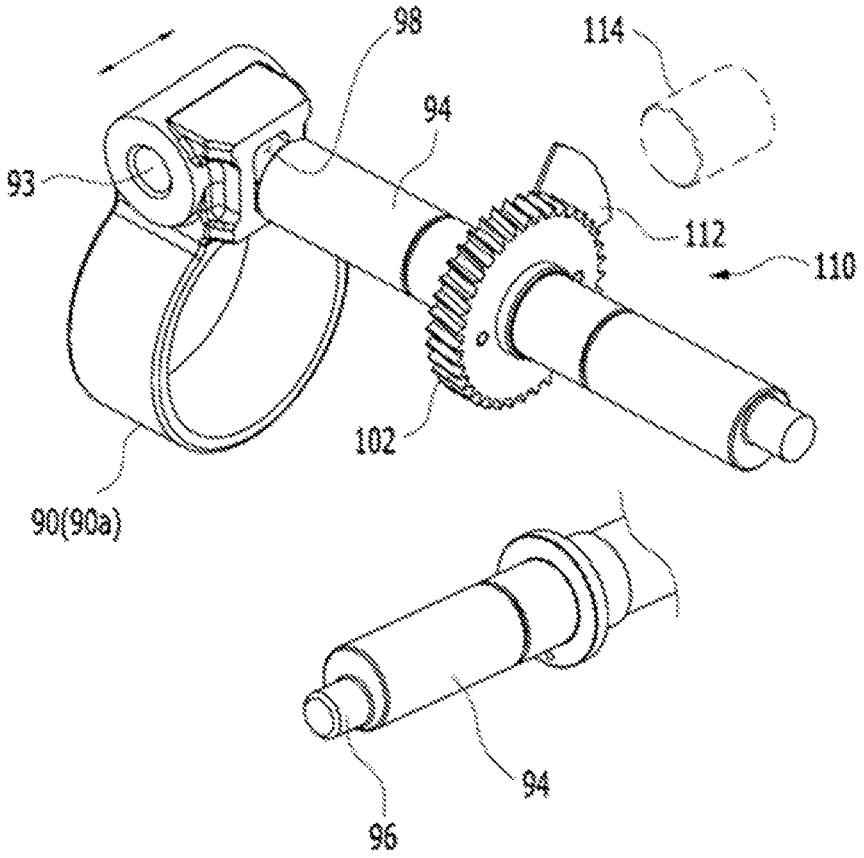
FIG. 7 is a drawing showing a slider housing and a control shaft applied to a continuous variable valve timing apparatus according to an exemplary embodiment of the present disclosure.

FIG. 6 is a cross-sectional view along a line VI-VI of FIG. 4 and FIG. 7 is a drawing showing a slider housing and a control shaft applied to a continuous variable valve timing apparatus according to an exemplary embodiment of the present disclosure.

Referring to FIG. 1 to FIG. 7, an engine according to an exemplary embodiment of the present disclosure includes an engine block 1, a cylinder head 10 and a continuously variable valve timing apparatus mounted to the cylinder head 10.

As best seen in FIGS. 4 and 5, the continuously variable valve timing apparatus according to an embodiment of the present disclosure includes a camshaft 30, first and second cam portions 70*a* and 70*b* having two cams 71 and 72 formed thereto, through which the camshaft 30 is inserted, and of which relative phase angles with respect to the camshaft 30 are variable. First and a second inner brackets 80*a* and 80*b* transmit rotation of the camshaft 30 to the first and second cam portions 70*a* and 70*b*, respectively. The first and second inner brackets 80*a* and 80*b* are rotatably inserted into first and a second slider housings 90*a* and 90*b*, respectively, and have relative positions with respect to the camshaft 30 that are variable. A cam cap 40 rotatably supports the first and second cam portions 70*a* and 70*b* together with the cylinder head 10, and is slidably mounted to the slider housings 90*a* and 90*b*. A control shaft 94 is disposed parallel with the camshaft 30 and selectively moves the first and the second slider housings 90*a* and 90*b*, and a control portion 100 selectively rotates the control shaft 94 so as to change positions of the inner brackets 80*a* and 80*b*.

The camshaft 30 may be an intake camshaft or an exhaust camshaft.

In the drawing, the cams 71 and 72, for driving valves 200, is formed as a pair, but it is not limited thereto.

The engine includes a plurality of cylinders 211, 212, 213 and 214 (FIG. 4), and the plurality of the cam portions 70 are disposed corresponding to the each cylinder 211, 212, 213 and 214, respectively.

In the drawing, four (4) cylinders are formed to the engine, but it is not limited thereto and may include more or less cylinders.

To the cam portions 70*a* and 70*b*, a cam cap connecting portion 76 for engaged with the cam cap 40 is formed between the first and the second cams 71 and 72. The cylinder head 10 and the cam cap 40 are connected with each other and the cam cap connecting portion 76 is rotatably disposed between the cam cap 40 and the cylinder head 10.

The cams 71 and 72 rotate and open the valve 200.

A rotation ring 60 having a ring key 62 transmitting the rotation to the first cam portion 70*a* and the second cam portion 70*b*, respectively, is mounted to the camshaft 30 and a cam key 74 is formed to the first and second cam portions 70*a* and 70*b*, respectively, and the rotation of the rotation ring 60 is transmitted to the first and second cam portions 70*a* and 70*b* through the first and second inner brackets 80*a* and 80*b* respectively.

The continuously variable valve timing apparatus may further include first pins 82 having a ring key slot 81, wherein each ring key 62 is slidably inserted thereto, and second pins 84 having a cam key slot 83, wherein each cam key 74 is slidably inserted thereto, and a first sliding pin hole 86 and a second sliding pin hole 88, of which the first pin 82 and the second pin 84 are inserted thereto respectively, are formed to the inner brackets 80*a* and 80*b*.

A camshaft hole 32 and a rotation ring hole 64 is formed to the camshaft 30 and the rotation ring 60, respectively, and a connecting pin 66 is inserted into the camshaft hole 32 and the rotation ring hole 64 for the camshaft 30 to be connected with the rotation ring 60.

The first pin 82 and the second pin 84 are formed as a circular cylinder shape, and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, wear resistance may be enhanced.

Also, productivity may be increased due to simple shapes of the first pin 82, the second pin 84, the first sliding pin hole 86 and the second sliding pin hole 88.

Parts of the first sliding pin hole 86 and the second sliding pin hole 88 are opened for movements of the ring key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

A guide hole 93 is formed to the each slider housing 90*a* and 90*b*, and wherein a guide rod 95 inserted into the guide hole 93 is connected with the cam cap 40 in order to guide movements of the slider housings 90*a* and 90*b*.

The control portion 100 includes a worm wheel 102 connected to the control shaft 94, a worm gear 104 engaged with the worm wheel 102 and a control motor 106 selectively rotating the worm gear 104. And an eccentric protrusion 96 is formed to an end of the control shaft 94, and a control hole 98 where the eccentric protrusion 96 is inserted therein is formed to the slider housings 90*a* and 90*b*, and the slider housings 90*a* and 90*b* move according to operation of the control motor 106.

As shown in FIG. 3 to FIG. 5, two first and two second cam portions 70*a* and 70*b* are sequentially disposed, two ring keys 62 are formed to the rotation ring 60, and rotation of one rotation ring 60 is transmitted to the first and the second cam portions 70*a* and 70*b* simultaneously.

For example, an engine with a first, second, third and fourth cylinders 211, 212, 213 and 214 may be provided with two rotation rings 60, two first and second cam portions 70*a* and 70*b*, two inner brackets 80*a* and 80*b*, two slider housings 90*a* and 90*b* and one control motor 106 and perform changing timing of each cam 71 and 72. Thus, the continuously variable valve timing apparatus according to an embodiment of the present disclosure may reduce numbers of elements, thus durability may be improved and operation stability may be obtained.

The continuously variable valve timing apparatus further includes a sensor unit 110 detecting movements of the slider housings 90.

The sensor unit 110 includes a sensor plate 112 mounted to the control shaft 94 and a sensor 114 detecting rotations of the sensor plate 112.

When the control shaft 94 moves according to rotation of the control motor 106, the sensor plate 112 mounted to the control shaft 94 rotates, the sensor 114 detects rotation of the sensor plate 112 and measures movements of the slider housings 90*a* and 90*b*.

Figure 8:
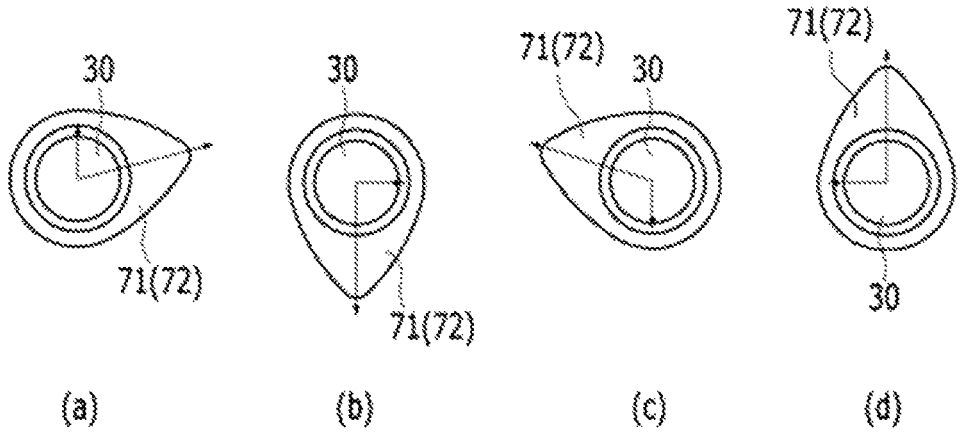
FIG. 8 and FIG. 9 are drawings showing mechanical motions of cams of a continuous variable valve timing apparatus according to an exemplary embodiment of the present disclosure.
Figure 9:
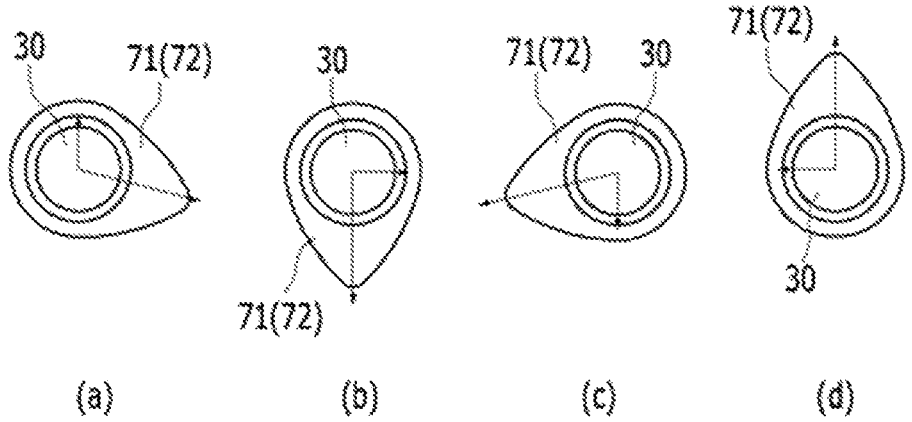

FIG. 8 and FIG. 9 are drawings showing mechanical motions of cams of a continuous variable valve timing apparatus according to an exemplary embodiment of the present disclosure.

According to engine operation states, an ECU (engine control unit or electric control unit) transmits control signals to the motor 106 of the control portion 100 to change a relative position of the slider housing 90.

In an embodiment of the present disclosure, the slider housing 90 moves left or right direction with respect to rotation center of the camshaft 30.

When the slider housing 90 moves to one direction with respect to the rotation center of the camshaft 30, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a as shown in FIG. 8.

When the slider housing 90 moves to opposite direction with respect to the rotation center of the camshaft 30, the rotation speed of the cams 71 and 72 is relatively slower than rotation speed of the camshaft 30 from phase a to phase b and from phase b to phase c, then the rotation speed of the cams 71 and 82 is relatively faster than rotation speed of the camshaft 30 from phase c to phase d and from phase d to phase a as shown in FIG. 9.

While rotation ring is rotated together with the camshaft 30, the ring key 62 is slidable within the ring key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 10:
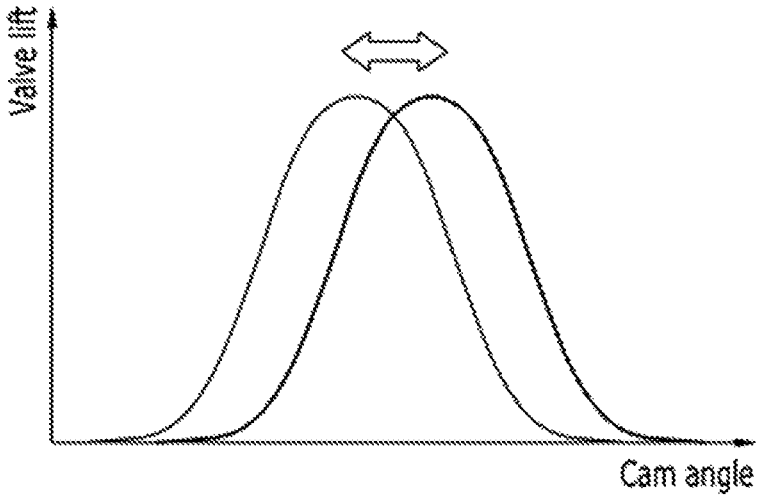
FIG. 10 is a graph of a valve profile of a continuous variable valve timing apparatus according to an exemplary embodiment of the present disclosure.

FIG. 10 is a graph of a valve profile of a continuous variable valve timing apparatus according to an embodiment of the present disclosure.

As shown in FIG. 10, although maximum lift of the valve 200 is constant, however rotation speed of the cam 71 and 72 with respect to the rotation speed of the camshaft 30 is changed according to relative positions of the slider housing 90 so that valve timing is changed and various valve profile or valve timing may be performed.

As an example shown in FIG. 10, duration of the valve 200 is constant and opening and closing time of the valve 200 is uniformly controlled, however, it is not limited thereto. According to mounting angle of the valve 200 and so on, various valve timing may be performed. That is, according to adjusting contacting positions of the cam 71 and 72 and the valve 200, the valve 200 closing timing may be constant, opening timing and closing timing of the valve 200 may simultaneously be changed or may be operated as a variable valve duration apparatus.

As described above, a continuous variable valve timing apparatus according to an embodiment of the present disclosure may vary valve timing according to operation conditions of an engine, with a simple construction.

The continuous variable valve timing apparatus according to an embodiment of the present disclosure may be reduced in size and thus the entire height of a valve train may be reduced.

Since the continuous variable valve timing apparatus may be applied to an existing engine without excessive modification, thus productivity may be enhance and production cost may be reduced.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

DESCRIPTION OF SYMBOLS

| | |
|---|---|
| 1: engine | 10: cylinder head |
| 30: camshaft | 40: cam cap |
| 42: cam cap hole | 60: rotation ring |
| 62: ring key | 64: connecting pin |
| 66: wheel hole | 70a, 70b: first and second cam portion |
| 71, 72: cam | 74: cam key |
| 76: cam cap connecting portion | |
| 80a, 80b: first and second inner bracket | |
| 81: ring key slot | 82: first pin |
| 83: cam key slot | 84: second pin |
| 86: first sliding pin hole | 88: second sliding pin hole |
| 90: slider housing | 92: bearing |
| 93: guide hole | 94: control shaft |
| 95: guide rod | 96: eccentric protrusion |
| 98: control hole | 100: control portion |
| 102: worm wheel | 104: worm gear |
| 106: control motor | 110: sensor unit |
| 112: sensor plate | 114: sensor |
| 200: valve | 211-214: 1-4 cylinder |

What is claimed is:

1. A continuously variable valve timing apparatus comprising:

a camshaft;

first and second cam portions having two cams formed thereto, the camshaft being inserted into the first and second cam portions, wherein relative phase angles with respect to the camshaft are variable;

first and second inner brackets transmitting rotation of the camshaft to the first and second cam portions, respectively;

first and second slider housings having the first and second inner brackets rotatably inserted thereinto, respectively, and having relative positions with respect to the camshaft that are variable;

a cam cap rotatably supporting the first and second cam portions together with a cylinder head, wherein the first and second slider housings are slidably mounted to the cam cap;

a control shaft disposed parallel with the camshaft and configured to move the first and the second slider housings; and a control portion configured to rotate the control shaft so as to change positions of the first and second inner brackets.

2. The continuously variable valve timing apparatus of claim 1, further comprising a rotation ring mounted to the camshaft and having a ring key transmitting the rotation to the first cam portion and the second cam portion, respectively, and wherein a cam key is formed to the first and second cam portions, respectively, and the rotation of the rotation ring is transmitted to the first and second cam portions through the first and second inner brackets, respectively.

3. The continuously variable valve timing apparatus of claim 2, further comprising:

first pins having a ring key slot, each ring key being slidably inserted to the ring key slots; and second pins having a cam key slot, each cam key being slidably inserted to the cam key slots, and wherein a first sliding pin hole and a second sliding pin hole, of which the first pin and the second pin are inserted thereto respectively, are formed in an outer surface of the first and second inner brackets, respectively.

4. The continuously variable valve timing apparatus of claim 3, wherein:

the first pin and the second pin are formed as a circular cylinder shape; and the first sliding pin hole and the second sliding pin hole are formed for the first pin and the second pin to be rotated therewithin.

5. The continuously variable valve timing apparatus of claim 4, wherein parts of the first sliding pin hole and the second sliding pin hole are opened for movements of the ring key and the cam key.

6. The continuously variable valve timing apparatus of claim 1, further comprising a first bearing inserted between the first slider housing and the first inner bracket and a second bearing inserted between the second slider housing and the second inner bracket.

7. The continuously variable valve timing apparatus of claim 1, wherein:

a cam cap connecting portion is formed between the two cams, and the cam cap connecting portion is rotatably disposed between the cam cap and the cylinder head.

8. The continuously variable valve timing apparatus of claim 7, wherein:

each slider housing of the first and second slider housings includes a guide hole, and wherein a guide rod inserted into the guide hole is connected with the cam cap to guide movements of the first and second slider housings.

9. The continuously variable valve timing apparatus of claim 1, wherein the control portion comprises:

a worm wheel connected to the control shaft;

a worm gear engaged with the worm wheel; and a control motor selectively rotating the worm gear, and wherein an eccentric protrusion is formed at an end of the control shaft, and a control hole where the eccentric protrusion is inserted therein is formed to the first and second slider housings, and wherein the first and second slider housings move according to operation of the control motor.

10. The continuously variable valve timing apparatus of claim 1, further comprising a sensor unit detecting movements of the first and second slider housings.

11. The continuously variable valve timing apparatus of claim 10, wherein the sensor unit comprises:

a sensor plate mounted to the control shaft; and a sensor detecting rotations of the sensor plate.

12. An engine comprising:

a camshaft;

a first and a second cam portions having two cams are formed thereto, wherein the camshaft is inserted into the first and second cam portions such that relative phase angles with respect to the camshaft are variable, and wherein the first and second cam portions have a cam key formed thereto, respectively;

a rotation ring mounted to the camshaft and having two ring keys formed thereto;

first and second inner brackets transmitting rotation of the rotation ring to the first and second cam portions, respectively;

first and second slider housings to which the first and second inner brackets are rotatably inserted, respectively, wherein the first and second slider housings have relative positions with respect to the camshaft that are variable;

a cam cap rotatably supporting the first and second cam portions together with a cylinder head, and wherein the first and second slider housings are slidably mounted to the cam cap;

a control shaft disposed parallel with the camshaft and configured to move the first and the second slider housings; and a control portion configured to rotate the control shaft so as to change positions of the first and second inner brackets.

13. The engine of claim 12, wherein the control portion comprises:

a worm wheel connected to the control shaft;

a worm gear engaged with the worm wheel; and a control motor selectively rotating the worm gear, and wherein an eccentric protrusion is formed to an end of the control shaft, and a control hole where the eccentric protrusion is inserted therein is formed in the first and second slider housings, and wherein the first and second slider housings move according to operation of the control motor.

14. The engine of claim 12, further comprising:

first pins having a ring key slot, each ring key slidably inserted to the ring key slots; and second pins having a cam key slot, each cam key slidably inserted to the cam key slots, and wherein a first sliding pin hole and a second sliding pin hole, of which the first pin and the second pin are inserted thereto respectively, are formed in an outer surface of the first and second inner brackets, respectively.

15. The engine of claim 12, further comprising: a first bearing inserted between the first slider housing and the first inner bracket; and a second bearing inserted between the second slider housing and the second inner bracket.

16. The engine of claim 12, wherein:

a cam cap connecting portion is formed between the two cams, and the cam cap connecting portion is rotatably disposed between the cam cap and the cylinder head.

17. The engine of claim 12, wherein:

a guide hole is formed in each slider housing of the first and second slider housings, and wherein a guide rod inserted into the guide hole is connected with the cam cap to guide movements of the first and second slider housings.

18. The engine of claim 12, further comprising:

a sensor plate mounted to the control shaft; and a sensor detecting rotations of the sensor plate.

* * * * *